United States Patent [19]

Boeckmann

[11] Patent Number: 4,634,959

[45] Date of Patent: Jan. 6, 1987

[54] TEMPERATURE COMPENSATED REFERENCE CIRCUIT

[75] Inventor: Eduard F. B. Boeckmann, Huntsville, Ala.

[73] Assignee: GTE Communication Systems Corp., Northlake, Ill.

[21] Appl. No.: 809,656

[22] Filed: Dec. 16, 1985

[51] Int. Cl.[4] ..... G05F 3/16

[52] U.S. Cl. ..... 323/313; 323/907; 340/813

[58] Field of Search ..... 323/313, 315, 907; 340/813; 307/296 R, 297, 317 R

[56] References Cited

U.S. PATENT DOCUMENTS 3,806,742 4/1974 Powell ..... 323/313 X
4,297,697 10/1981 Mitsui ..... 340/813
4,380,728 4/1983 Kearney ..... 323/313 X

OTHER PUBLICATIONS

Chung C. Liu, "Temperature Compensated Voltage Reference Source" *IBM Technical Disclosure Bulletin*, vol. 14, No. 4, Sep. 1971, pp. 1223–1224.

*Primary Examiner*—Patrick R. Salce
*Assistant Examiner*—Marc S. Hoff
*Attorney, Agent, or Firm*—Robert J. Black

[57] ABSTRACT

A temperature compensated voltage reference circuit adapted for on chip location with integrated bi-polar linear circuits, where a temperature stable reference voltage is required in the range of 1.2 to 2.0 volts DC. The circuitry requires only a low chip area and presents a high AC impedance, a low operating current drain, and requires no high value resistors or capacitors.

6 Claims, 1 Drawing Figure

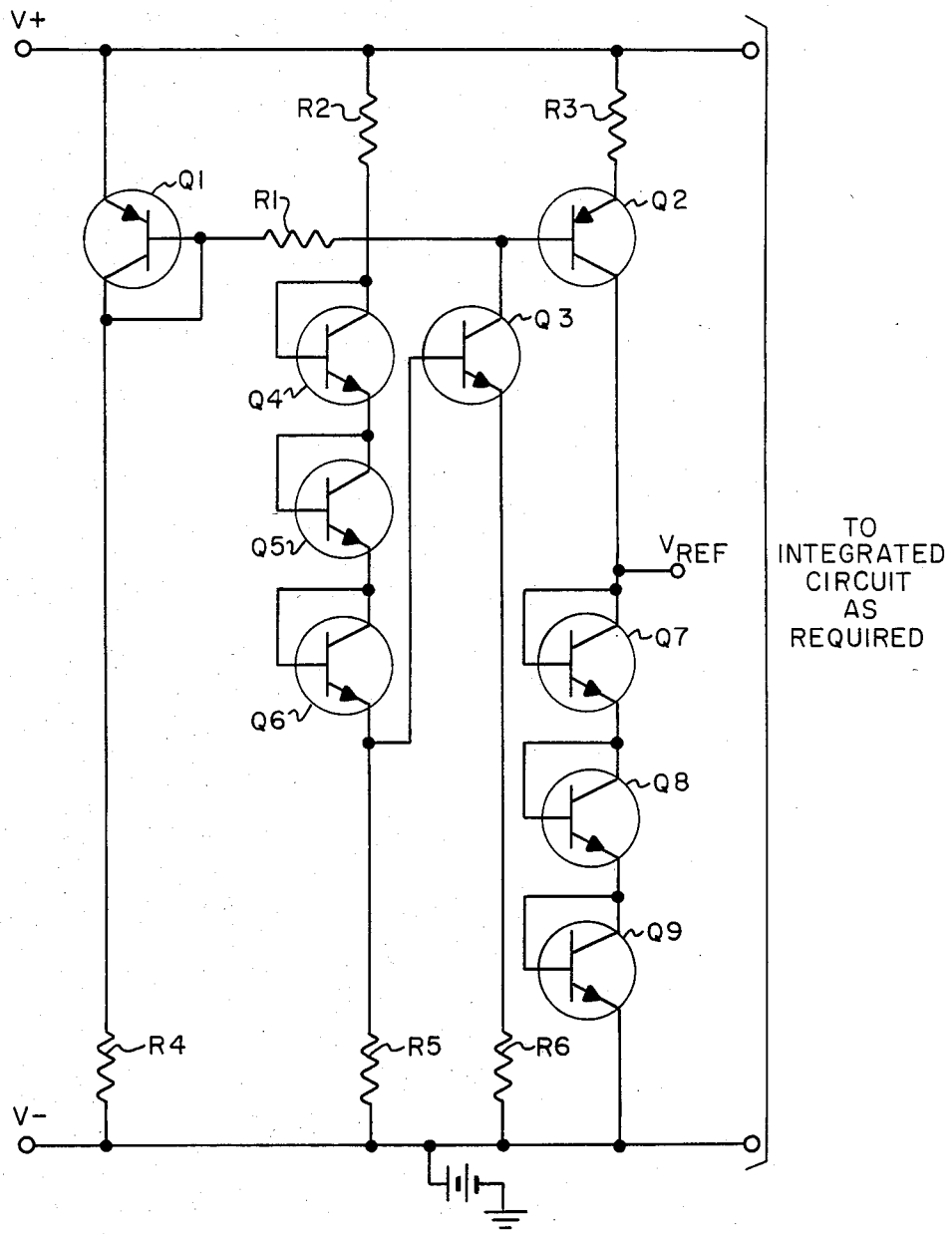
V+
R2
R3
Q1
R1
Q2
Q3
Q4
Q5
Q6
VREF
Q7
Q8
Q9
R4
R5
R6
V-
TO
INTEGRATED
CIRCUIT
AS
REQUIRED

TEMPERATURE COMPENSATED REFERENCE CIRCUIT

BACKGROUND OF THE INVENTION (1) Technical Field

The present invention relates to voltage reference circuits and more particularly to a voltage reference circuit for use with integrated bipolar linear circuits where a temperature stable reference voltage is needed in the range of 1.2 to 2.0 volts DC.

(2) Background Art

Numerous integrated circuit voltage references are available. An example of such a device in the low voltage range of approximately 1.2 volts is that manufactured by National Semiconductor under their part number LM313 which demonstrates a temperature stability of plus or minus one percent over a temperature range O° C. to 70° C. However at the present time in the event of the need for a device with a negative or positive temperature coefficient other than zero, little or nothing is available to meet such requirements.

In the Gamma TM Telephone as manufactured by GTE Communication Systems Corporation, the desired temperature compensation was achieved with a discrete component reference using a combination of a 2.7 volt zener diode and silicon diode. This method however was not suitable for integration.

SUMMARY OF THE INVENTION

The present invention provides a voltage reference having a negative temperature coefficient of approximately −4 millivolts per degree centigrade on 1.2 volts, or about −0.33% per degree centigrade. This design is required to compensate for the characteristics of certain types of liquid crystal displays which require a voltage regulator. The present design includes such desirable features as requiring only low chip area on the associated integrated circuit device, no high value resistors and no capacitors are required the circuit demonstrates a high AC impedance and a low operating current drain.

The present invention includes a resistance ratioed current mirror, modified to include temperature sensing and current output compensation for temperature change. The compensated current is fed to a diode string to form the final reference voltage as the summation of forward voltage drops of the diodes. As temperature rises for example the current source forces more current through the output diode string (the reference element) thereby counteracting the negative temperature coefficient of the diode string to a greater or lesser extent depending on the degree of compensation used.

In the present circuitry three transistors form the main active element of the circuit. The first transistor of the PNP type, provides a single diode drop potential and provides the primary reference bias current for the second transistor. The second transistor forms the current gate for output current to the diode reference string. The third transistor acts as a secondary temperature compensating source of bias current for the second or current gating transistor. Bias for this third transistor is determined by two resistors and a diode string connected so that the transistor receives a higher bias current as the temperature increases. The third transistor therefore being of the NPN type, turns on harder providing more bias current sinking for the base of the second transistor which is of the PNP type and is the current gating transistor. Thus the current gating transistor is turned on harder and provides current on an increased basis to the output diode string thereby stabilizing the reference voltage output to a certain degree (more or less negative). Compensation therefore is achieved over the design range.

The diodes referred to above are actually diode connected transistors so that they may be implemented in bi-polar integrated circuit form (silicon chip integrated circuit device). It is very important however in the design of the present circuitry that the transistors be matched.

BRIEF DESCRIPTION OF THE DRAWINGS

The single sheet of drawings provided herewith is a schematic circuit diagram of a temperature compensated voltage reference circuit in accordance with the present invention.

DESCRIPTION OF THE PREFERRED EMBODIMENT

Referring now to the accompanying drawing, the temperature compensated voltage reference circuit of the present invention is implemented with the use of transistors and resistors. An unregulated source of voltage not shown, is assumed to be within the design range of the circuit and the design is well within the capability of those skilled in the art, particularly in as much as it does not form a portion of the present invention. Likewise no specific application of the present temperature compensated reference circuit has been shown in as much as many various and sundry applications are possible.

As seen in FIG. 1, transistor Q1 which is of the PNP type and resistor R4 in combination form the primary bias reference for transistor Q2 which is also of the PNP type. Transistors Q4, Q5 and Q6 are diode connected transistors of the NPN type, forming a temperature variable forward voltage drop in series with the voltage drops on resistors R2 and R5, therefore forming a temperature variable voltage divider bias network for NPN transistor Q3. Transistor Q3 therefore forms a compensation bias sink path for transistor Q2 allowing transistor Q2 to gate on harder with increasing temperature. Transistor Q2 therefore forces more current through the diode connected transistors Q7, Q8 and Q9 to develop a temperature compensated reference at the collector of transistor Q7. With the circuit implemented as shown, approximately 1.2 to 1.3 volts with a −4 millivolt per degree centigrade temperature coefficient will be realized. The input voltage (V+) is approximately 3 to 6 volts for proper operation depending on the value of the resistors in the circuit.

It should be further noted that the transistors Q7, Q8 and Q9 are also diode connected. It is particularly important that transistors in both diodes strings are matched in order to obtain proper tracking between the sensing diode string (transistors Q4, Q5 and Q6) and the reference elements string (transistor Q7, Q8, and Q9).

It will be obvious to those skilled in the art that numerous modifications and variations can be made of the present invention without departing from the spirit of the present invention which shall be limited only by the scope of the claims appended hereto.

What is claimed is:

1. A temperature compensated voltage reference circuit connected to an input voltage source, said reference circuit comprising; a diode reference string and a current gate serially connected in shunt across said input source; a a primary bias circuit connected in shunt across said input voltage source and including an output connected to said current gate; a secondary bias circuit including an output connected to said current gate; biasing means forsaid at secondary bias circuit connected in shunt across said input voltage source and including an output connected to said secondary bias circuit; said diode reference string and said biasing means for said secondary bias circuit each including a plurality of matching transistors; and a reference voltge output connected to a junction between said reference string and said current gate, said current gate forcing current through the diode reference string to develop a temperature compensated reference voltage at said reference voltage output.

2. A temperature compensated voltage reference circuit as claimed in claim 1, wherein: said diode reference string comprises a plurality of diode connected transistors which, form the final reference voltage of said reference circuit as the summation of forward voltage drops of said diode connected transistors.

3. A temperature compensated voltage reference circuit as claimed in claim 1, wherein: and current gate comprises a transistor, gating current for output to said diode reference string.

4. A temperature compensated voltage reference circuit as claimed in claim 1, wherein: said primary bias circuit comprises a transistor and a resistor serially connected across said input voltage source, said transistor providing a single diode drop potential.

5. A temperature compensated voltage reference circuit as claimed in claim 1, wherein: said secondary bias circuit for said current gate comprises a transistor forming a compensation bias sink path for said current gate, allowing said current gate to pass more current with increasing temperature.

6. A temperature compensated voltage reference circuit as claimed in claim 5, wherein: said biasing means for said secondary bias circuit comprise a plurality of transistors diode connected in series with a plurality of resistors and including an output connected to said secondary bias circuit.

* * * * *